United States Patent [19]

Bert

[11] Patent Number: 4,819,976

[45] Date of Patent: Apr. 11, 1989

[54] DOOR LATCH

[75] Inventor: Brian J. Bert, Chester, Ill.

[73] Assignee: American Device Manufacturing Company, Steeleville, Ill.

[21] Appl. No.: 39,958

[22] Filed: Apr. 20, 1987

[51] Int. Cl.[4] ..... E05C 9/04

[52] U.S. Cl. ..... 292/48

[58] Field of Search ..... 292/21, 48, 92, 216, 292/336

[56] References Cited

U.S. PATENT DOCUMENTS

| | | | |
|---|---|---|---|
| D. 268,003 | 2/1983 | Ohno | D8/302 |
| 1,203,116 | 10/1916 | Hurd | 232/2 |
| 1,253,545 | 1/1918 | Tompkins et al. | 232/2 |
| 1,430,905 | 10/1922 | Hurd . | |
| 1,612,480 | 12/1926 | Wells | 232/2 |
| 1,706,486 | 3/1929 | Gasey . | |
| 2,824,440 | 2/1958 | Jewett et al. | 70/92 |
| 3,083,560 | 4/1963 | Scott | 292/21 X |
| 3,189,142 | 6/1965 | Carlson | 189/47 |
| 3,325,203 | 6/1967 | Moler | 292/201 |
| 3,477,260 | 11/1969 | Balducci et al. | 70/92 |
| 3,583,740 | 6/1971 | Armstrong | 292/21 X |
| 3,697,105 | 10/1972 | Marx | 292/216 |
| 3,705,739 | 12/1972 | Adler | 292/92 |
| 3,776,582 | 12/1973 | Balducci | 292/92 |
| 3,811,717 | 5/1974 | Floyd et al. | 292/92 |
| 3,819,213 | 6/1974 | Vanderburgh | 292/21 |
| 3,854,763 | 12/1974 | Zawadezki et al. | 292/201 |
| 3,869,159 | 3/1975 | Eads | 292/92 |
| 3,877,262 | 4/1975 | Williams | 70/92 |
| 4,007,954 | 2/1977 | Erickson | 292/165 |
| 4,012,066 | 3/1977 | Salvatore | 292/341.13 |
| 4,015,869 | 4/1977 | Horvath | 292/341.16 |
| 4,074,548 | 2/1978 | Milton | 70/1.5 |
| 4,083,590 | 3/1978 | Folger | 292/92 |
| 4,183,565 | 1/1980 | Allemann | 292/163 |
| 4,311,329 | 1/1982 | Kral | 292/92 |
| 4,384,738 | 5/1983 | Floyd | 292/92 |
| 4,709,950 | 12/1987 | Zortman | 292/92 |

FOREIGN PATENT DOCUMENTS

| | | |
|---|---|---|
| 2340580 | 2/1975 | Fed. Rep. of Germany . |
| 1150986 | 9/1957 | France . |
| 575646 | 4/1958 | Italy . |
| 2084643 | 10/1980 | United Kingdom . |

*Primary Examiner*—Richard E. Moore

*Attorney, Agent, or Firm*—Cohn, Powell & Hind

[57] ABSTRACT

A door latch mechanism mounts on a door for selectively engaging a door strike. A latch bolt moves along a line of action to disengage the strike and allow the door to be opened. A dead lock prevents unwanted opening of the door and includes a blocking element to prevent movement of the latch bolt along its line of action. A release enables the latch bolt to move along its line of action and includes a bell crank for displacing the blocking element whereby the latch bolt can disengage the strike.

20 Claims, 2 Drawing Sheets

DOOR LATCH

BACKGROUND AND SUMMARY OF THE INVENTION

This invention relates to door latches and more particularly, to a door latch mechanism for emergency exit doors.

Applicant is aware of the following U.S. patents, the disclosures of which are incorporated by reference herein.

U.S. Pat. No. 1,203,116
U.S. Pat. No. 1,430,905
U.S. Pat. No. 1,706,486
U.S. Pat. No. 3,325,203
U.S. Pat. No. 3,189,142
U.S. Pat. No. 3,705,379
U.S. Pat. No. 3,819,213
U.S. Pat. No. 3,869,159
U.S. Pat. No. 4,007,954
U.S. Pat. No. 4,015,869
U.S. Pat. No. 4,083,590
U.S. Pat. No. 4,311,329
U.S. Pat. No. 1,253,545
U.S. Pat. No. 1,612,480
U.S. Pat. No. 2,824,440
U.S. Pat. No. 3,335,509
U.S. Pat. No. 3,477,260
U.S. Pat. No. 3,811,717
U.S. Pat. No. 3,854,763
U.S. Pat. No. 3,877,262
U.S. Pat. No. 4,012,066
U.S. Pat. No. 4,074,548
U.S. Pat. No. 4,183,565
U.S. Pat. No. 4,384,738

Emergency exit doors, as typically known in the art, serve the function of providing access from a building or area only under certain extraordinary situations. Most of the time these doors remain closed and it is a particular requirement of such doors that they be tamperproof, i.e. not openable by unauthorized persons using a credit card, pry bar or other tool. While the need for their tamperproof feature or "dead lock" is apparent, at the same time, this feature should not unduly complicate the latching and unlatching mechanism or else the possibility of this mechanism jamming or becoming otherwise inoperative increases. And, despite the importance of foregoing, it is also important to avoid impractical and costly alternatives such as having the the deadlock mechanism separate from the latching mechanism.

Certain doors, such as those in schools and other public buildings, must remain locked during a fire in order to prevent its spread. This means the latching mechanism must include a fire or heat responsive element, a fusible material, which renders the latching mechanism inoperative in the presence of a fire or intense heat. The material, or a portion of the mechanism using it, must be easily activated in the event of a fire to make the door unoperable while, under more usual circumstances, not interferring with normal functioning of the latch mechanism.

Finally, the latching mechanism itself should be simple so the deadlock and fusible element integrate easily with it. The mechanism should be readily installed on a door, and once installed, should require little or no maintenance for proper operation.

The present invention is advantageous in that it provides a latching mechanism for emergency exit doors that is readily installed on the door. The mechanism incorporates a latch bolt that moves along a line of action to engage or disengage a door strike, then allowing the door to be closed and opened. The mechanism also incorporates a dead lock feature that blocks movement of the latch bolt along its line of action to provide a relatively simple, yet effective, dead lock that prevents tampering. The latch also includes a release mechanism which disengages the dead lock so the door can be opened at the necessary or proper times. This release mechanism also restores the dead lock when it is intended for the door not to be operable.

In addition to the above, the latch has a fusible lock feature that operates in the presence of fire or intense heat to make the release mechanism inoperable. Consequently the door cannot be opened in these situations. At all other times, however, the fusible lock does not interfere with operation of the release and opening or closing of the door.

The latch preferably has an upper and a lower latch bolt which engage respective upper and lower door strikes. Each latch bolt has an associated dead lock and the release mechanism is designed to operate both dead locks simultaneously to enable the door to be opened and to restore them simultaneously when it is intended that the door not be opened.

DESCRIPTION OF THE DRAWINGS

Corresponding reference characters indicate corresponding parts throughout the several views of the drawings.

DESCRIPTION OF A PREFERRED EMBODIMENT

Figure 1:
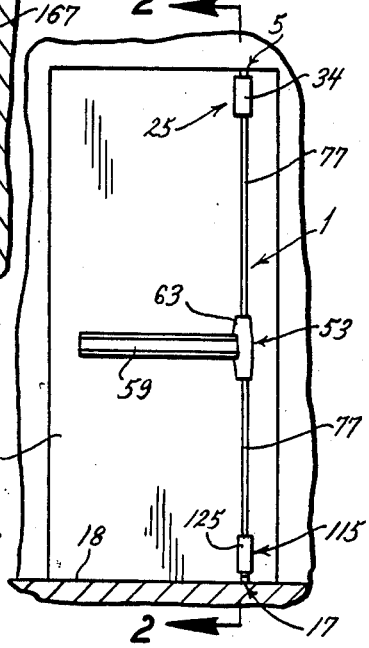
FIG. 1 is a side elevational view of an emergency exit door with the latch mechanism of the present invention installed.

Referring to the drawings, a door latch mechanism 1 of the present invention is indicated generally in FIG. 1. The mechanism 1 is designed for installation on a door 3 which may, for example, be an emergency exit door. As such, it is intended that door 3 be normally closed but quickly openable in the event of an emergency. Since the door is meant to normally closed, it should not be openable by someone tampering with it or with the latch mechanism. Door 3 has an associated first door strike 5 mounted to the door frame or the like adjacent to the top of the door. The strike 5 has a base plate 7 which is affixed to the door frame by screws 9. The strike 5 is generally triangular in shape with a vertically depending flat forward face 11, which is offset from the front face 13 of door 3. Strike 5 has a sloping rear face 15.

The door 3 also has an associated second door strike 17 mounted on the floor 18 at the foot of the door. Strike 17 is similar to strike 5 in that it has a bare plate 19 which is affixed to the floor by screws. The strike 17 is again generally triangular in shape with a vertically extending flat forward face 21 and a sloping rear face 23.

Latch mechanism 1 selectively engages the door strikes to keep door 3 closed; and for this purpose the mechanism includes a latch bolt means 25. Means 25 includes a base plate 27 secured to the upper end of door face 13 by screws 29. Side plates 31A and 31B extend outwardly from the opposite sides of the base plate 27 to form a U-shaped frame 33, the channel formed by the base plate 27 and side plates 31A and 31B being vertically oriented when the assembly is mounted on the door 3. A cover 34 fits over the frame 33.

A latch bolt 35 is mounted between the side plates 31 at the upper end of the frame 33. A pivot pin 37 extends between the side plates 31A and 31B with the respective ends of the pin 37 projecting through corresponding holes in the upper end of the respective side plates 31A and 31B. The ends of the pin 37 have retaining rings or other means to secure the pin 37 to the frame 33. The latch bolt 35 is of segmental shape with an arcuate face 39 abutting face 15 of strike 5. With the latch bolt 35 in its position engaging the strike 5, the latch bolt 35 has an exposed, flat, outer face 41. It is possible that someone wishing to tamper with the door 3 may try to open door 3 by pushing against face 41 with a credit card or pry tool.

To prevent unwanted opening of door 3, mechanism 1 includes a deadlock means 43. Means 43 includes an arm 45 attached to the latch bolt 35 and extending from the latch bolt 35 along its line of action. Arm 45 comprises two parallel plates 45A and 45B which abut each other and have rounded upper ends and tapered lower ends, as shown. Latch bolt 35 has a central web of material 47 on its underside and the upper ends of plates 45A and 45B are attached to opposite sides of the web 47 by a pin 49.

Dead lock means 43 further includes a pin 51 extending transversely of the line of action of the latch bolt 35. Pin 51 is attached to side plates 31A and 31B and the distal end of arm 45 bears against the pin 51 when the latch bolt 35 is in its strike engaging or extending position. Consequently, when someone tries to tamper with the latch bolt 35 by pushing against face 41, the arm 45 bearing against pin 51 prevents inward movement of the latch bolt 35.

To allow door 3 to be opened, mechanism 1 also includes a release means 53. Means 53 enables latch bolt 35 to move inwardly along its line of action away from strike 5. For this purpose, the release means includes a bell crank 55 which pivots about pin 51. Arm 45 is attached, at its lower end, to the bell crank 55 by a pin 57. Thus, when the bell crank 55 is rotated about pin 51, in a manner to be described, arm 45 is displaced from its position abutting pin 51 and latch bolt 35 is freed to move along its line of action and disengage strike 5.

Figures 2, 3:
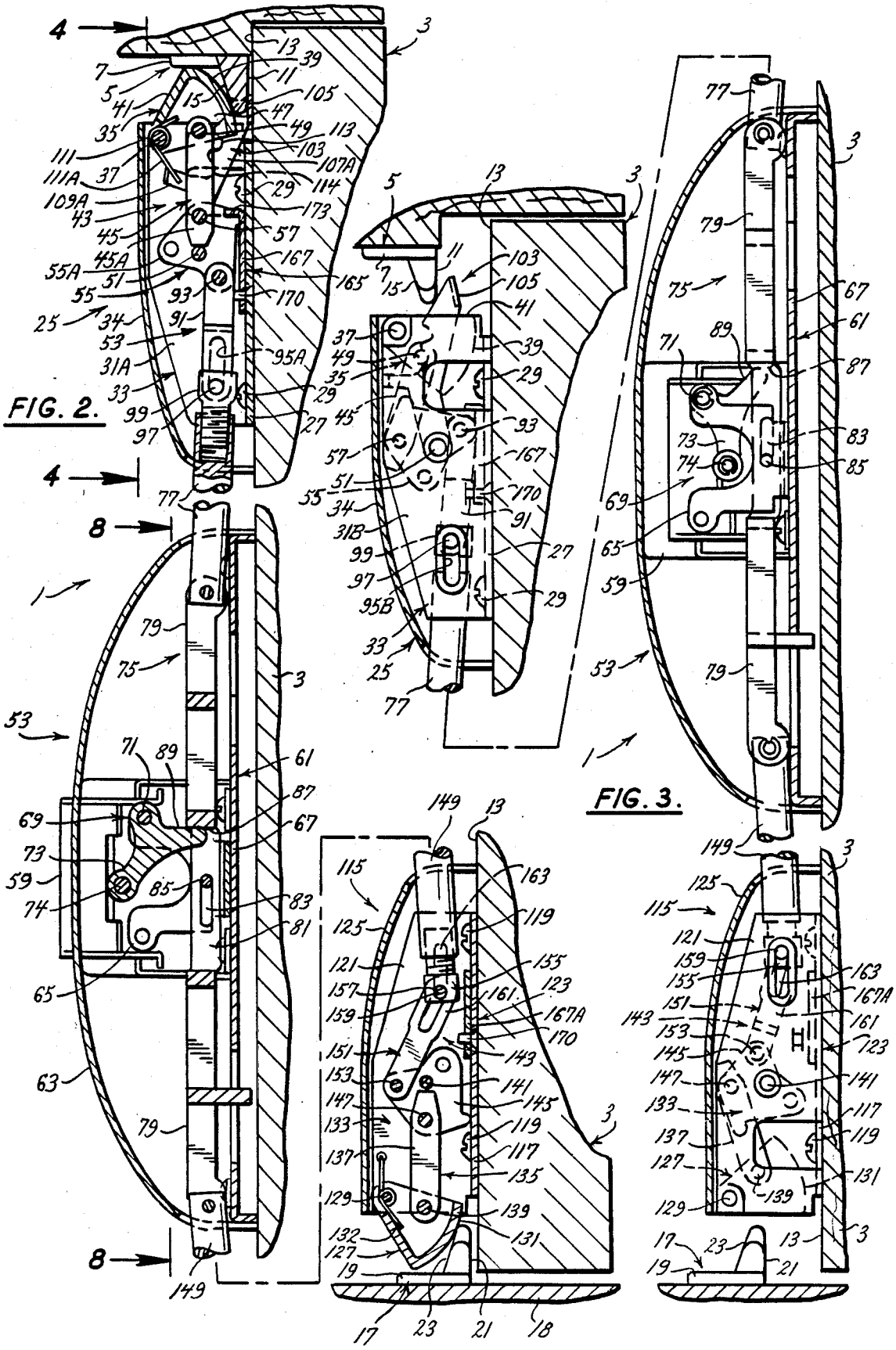
FIG. 2 is a sectional view of the latch mechanism taken along line 2—2 in FIG. 1 and illustrating the position of the mechanism when the door is closed.
FIG. 3 is the same sectional view shown in FIG. 2, but with the door opened.

The release means 53 includes a manually operable bar 59 which is mounted to door 3 as shown in FIG. 1. Operation of bar 59 is well known in the art and will not be described in detail. As shown in FIG. 2, a frame assembly 61 is secured to door 3 at approximately waist height (see FIG. 1). A cover 63 fits over the frame and bar 59 protrudes through an opening in the cover 63. A U-shaped bracket 65 is attached to base plate 67 of the frame assembly 61 and a bell crank 69 is rotatably secured to one arm of the bracket 65 by a pin 71. An arm 73 of bell crank 69 has an extension 74 connected to bar 59. When the bar 59 is moved to the right, as shown in FIG. 2, the bell crank 69 is caused to rotate counterclockwise (CCW).

Release means 53 includes a linkage means 75 comprising an upper linkage rod 77 connected to a central link 79. Link 79 has a middle section 81 which includes a vertical slot 83. A pin 85 extending outwardly from bracket 65 fits in slot 83 to limit the vertical movement of the linkage means 75. Link 79 has a shoulder 87 formed at the upper end of section 81 and an arm 89 of bell crank 69 bears against this shoulder 87. At the position shown in FIG. 2, pin 85 is at the upper end of slot 83. Consequently, when bar 59 is pushed inwardly, the resultant CCW rotation of bell crank 69 causes linkage means 75 to be moved upwardly by the force exerted on shoulder 87 by crank arm 89. The extent of this movement is limited by the length of slot 83.

A yoke shaped link 91 has its stem end secured between plates 55A and 55B of bell crank 55 by a pin 93. Plates 31A and 31B have corresponding vertical slots 95A and 95B formed at their lower end and a pin 97 extends between the plates 31A and 31B and fits through the respective slots 95A and 95B. The bifurcated arms of link 91 have holes through which pin 97 fits. The upper end of rod 77 is internally threaded and an adjustment plug 99 is screwed into this end. Plug 99 has a cross bore 101 through which pin 97 also fits. Consequently, upward movement of rod 77 produces concomitant movement of link 91 which, in turn, produces CCW rotation of bell crank 55 (as seen in FIGS. 2 and 3). Since arm 45 is pinned to the bell crank 55, rotation of the bell crank 55 pulls the arm 45 away from pin 51, thereby displacing the element (arm 45) blocking movement of latch bolt 35 along its line of action. The above described action produces inward movement of the latch bolt 35 and it disengages strike 5.

Figure 4:
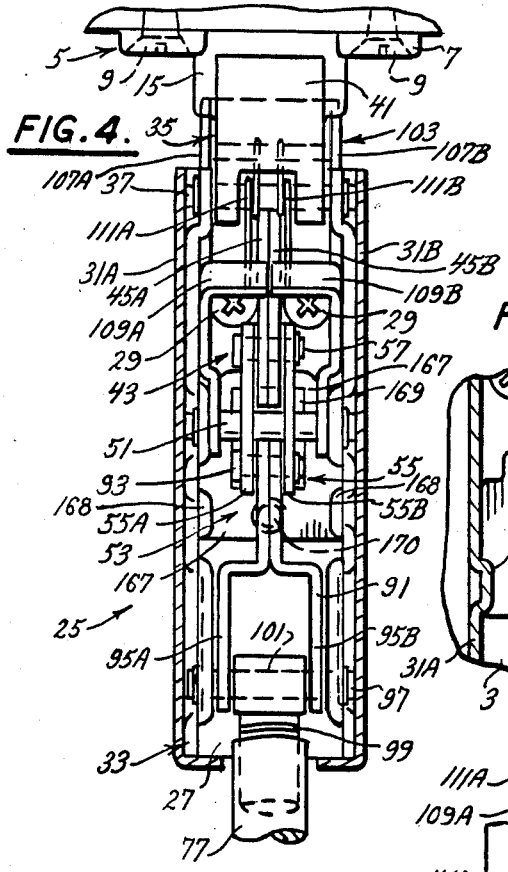
FIG. 4 is a sectional view of a portion of the mechanism taken along line 4—4 in FIG. 2 and illustrating the latch bolt and dead lock features of the mechanism.
Figure 6:
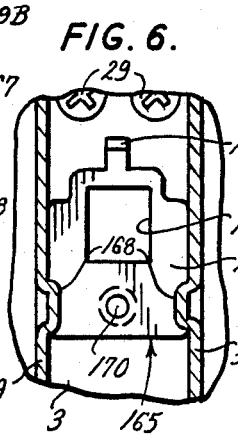
FIG. 6 is a sectional view taken along line 6—6 in FIG. 5 and illustrating a fusible lock feature of the invention.
Figure 5:
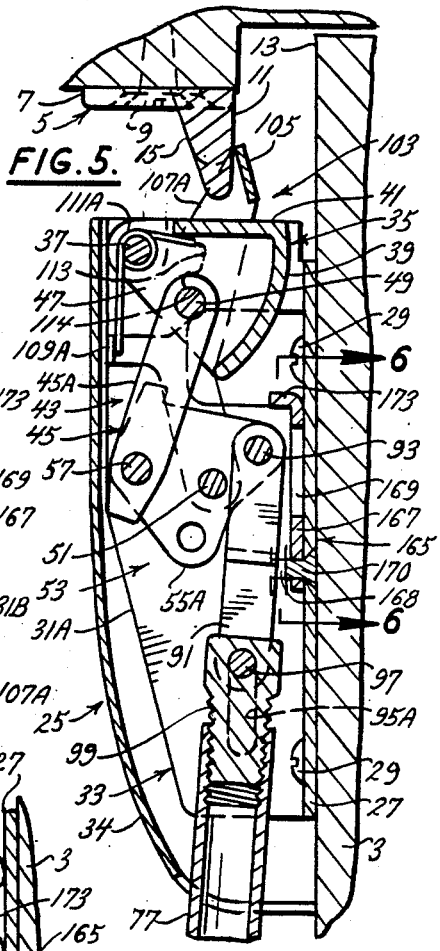
FIG. 5 is a sectional view of the upper portion of the mechanism similar to that in FIG. 3 where the door is opened.
Figure 7:
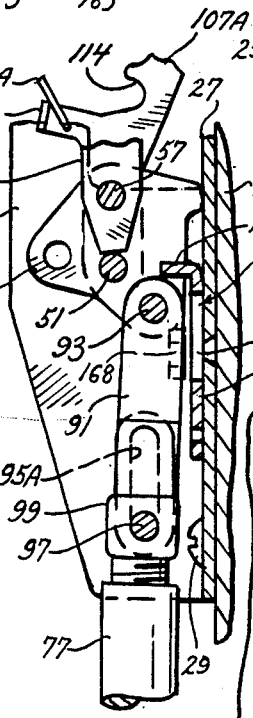
FIG. 7 is a partial sectional view of the upper portion of the mechanism similar to that shown in FIG. 2 and illustrating operation of the fusible lock and, FIG. 8 is a sectional view taken along line 8—8 in FIG. 2 and illustrating a portion of the release structure of the mechanism.
Figure 8:
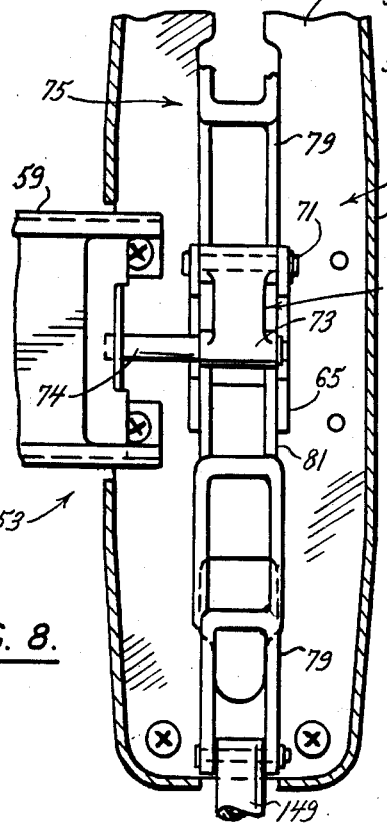

As this movement occurs, a latch lever 103 is moved from its retracted position shown in FIG. 2 to its extended position shown in FIG. 3. Lever 103 has a base plate 105 abutting face 11 of strike 5 when latch bolt 35 is in its position engaging the strike 5. The lever 103 has side rails 107A and 107B. These side rails 107A and 107B have corresponding openings through which pin 51 is inserted. Thus, lever 103 pivots about pin 51. Each side rail 107A and 107B has an outwardly extending inverted L-shaped arm, 109A and 109B respectively, the base legs of which meet so to form a generally inverted U-shaped member when viewed as shown in FIG. 4.

A coil spring 111, having legs 111A and 111B, is mounted on pin 37. The legs 111A and 111B of the spring 111 bear against the respective arms 109A and 109B. The center of spring 111 is positioned on the underside of face 41 of latch bolt 35 and is coiled around pin 37. As the latch bolt 35 disengages strikes 5, the inward movement of the latch bolt 35 causes the underside of face 41 to bear against an end 111B of spring 111.

This, in turn, causes the end 111A to urge lever 103 in a CCW direction by exerting a force on lever arms 109A and 109B. Each of side rails 107A and 107B of the lever 103 has detents 113 and 114. As latch bolt 35 moves inwardly along its line of action disengaging strike 5, the simultaneous CCW movement of lever 103 causes the detents 113 or 114 to capture pin 49. When this occurs, latch bolt 35 is completely withdrawn into frame 33 and is clear of strike 5. Thus, door 3 can be opened.

The latch bolt 35/lever 103 arrangement is held in a retracted position at this point. That is, latch bolt 35 cannot move because pin 49 is held in the detents 113 or 114 in the side rails 107A and 107B and lever 103 cannot be further extended for the same reason.

When door 3 is reclosed, base plate 105 of lever 103 strikes face 11 of strike 5 thus moving lever 103 and disengaging pin 49 allowing latch bolt 35 to move outward along its line of action due to spring 111 and gravity. This simultaneously allows the linkage means 75 to return to position and causes tapered end of arm 45 to sit atop of pin 51, as shown in FIG. 2. The latch bolt 35 re-engages strike 5. This restores mechanism 1 to its original state with door 3 closed.

With the lock mechanism 1 restored to its original position, arm 45 again blocks movement of latch bolt 35 along its line of action.

As previously described, a second door strike 117 may be secured to the floor at the base of door 3. Lock mechanism 1 preferably includes a second latch bolt means 115 movable along a line of action concurrently with first latch bolt means 25 to simultaneously disengage strike 17, when strike 5 is disengaged, permitting door 3 to be opened. Means 115 includes a base plate 117 secured to the lower end of door face 13 by screws 119. Sides plates 121 (only one of which is shown in FIGS. 2 and 3) extend outwardly from opposite sides of plate 117 to form a U-shaped frame 123. As with frame 33, the channel formed by the base and side plates is vertically oriented when the assembly is mounted to the door. A cover 125 fits over the frame 123.

A latch bolt 127 is mounted between the sides plates 121 and is of the same construction as bolt 35. The bolt 127 is pivotably secured to the side plates 121 by a pin 129. An arcuate face 131 of the latch bolt 127 abuts face 23 of strike 17. Latch bolt 127 has a spring 132 coiled around pin 129 and anchored to side plate 121, as shown. Spring 132 urges latch bolt 127 outwardly into a strike engaging position.

Lock mechanism 1 includes a second dead lock means 133 for blocking movement of latch bolt 127 along its line of action to prevent tampering. Means 133 includes an arm 135 comprised of two parallel plates 137, only one of which is shown in the drawings. Arm 135 is attached to latch bolt 127 by a pin 139. The second dead lock means also includes a pin 141 which extends transversely of the line of action of latch bolt 127 and is attached to the side plates 121. The tapered end of arm 135 presses against pin 141 and blocks inward movement of the latch bolt 127.

To allow door 3 to be opened, mechanism 1 includes a second release means 143. Means 143 includes a bell crank 145 which pivots about pin 141. Arm 135 is atached, at its tapered end, to the bell crank 145 by a pin 147. As described previously, rotation of the bell crank 145 about its pin 147 causes the arm 135 to be displaced away from the pin 147 in a pivoting action, thus unblocking the latch bolt 127 for inward movement.

To achieve simultaneous operation of the upper and lower latch bolts 35 and 127. Linkage means 75 includes a lower linkage rod 149 connected to the lower end of central link 79. A lower link 151 is connected to bell crank 145 by a pin 153. The lower end of rod 149 is internally threaded and an adjustment plug 155 is screwed into this end. Plug 155 has a cross bore 157 and a pin 159 fits through this bore and an opening in a bifurcated arm 161 of link 151. Side plates 121 each have a vertical slot 163 through which the respective ends of pin 159 extend.

In operation, upward movement of the linkage means 79, when bar 59 is depressed, moved to the right in FIG. 2, results in rod 149 being lifted and bell crank 145 rotated clockwise. This action moves arm 135 to the left, as shown in FIG. 2, off of pin 141, allowing latch bolt 127 to move inwardly along its line of action and disengage strike 17.

When the door is closed, downward movement of rod 149 rotates bell crank 145 CCW, moving arm 135 to the right as shown in FIG. 2. This produces outward movement of the latch bolt to re-engage strike 17 and the end of arm 135 again bears against pin 141 to block inward movement of the latch bolt 127.

Sometimes, for example in the presence of fire or intense heat, it is important to render lock mechanism 1 inoperable. This is to prevent door 3 from opening and providing a path for the fire or its associated heat and smoke. For this purpose, lock mechanism 1 includes a heat sensitive means 165 for inhibiting operation of the release means. Means 165 includes a stop 167 of generally rectangular shape with a central rectangular opening 169.

Stop 167 is mounted to base plate 27 and held in place by a fusible material 170, such as a fusible rivet or grommet. In the presence of fire or intense heat, the fusible material 170 melts and the stop 167 falls, by gravity, down the channel formed by plate 27 and side walls 31A and 31B. Tabs, not shown, extending outwardly from base plate 27 may be provided to guide movement of stop 167.

The stop is initially located on plate 27 so to be immediately behind bell crank 55 as shown in FIG. 4. An L-shaped dog 173 may be formed at the upper end of the stop 167 and projects outwardly into the channel. As the stop falls, this dog wedges itself against the upper end of link 91. Now, if someone tries to open the door, the dog 173 prevents movement of the linkage by preventing movement of link 91. Thus, the latch bolts 35 and 127 can't be moved to disengage the strikes and the door remains closed. As shown in FIG. 2, dog 173 may be omitted from stop 167A. When the fusible material 170 melts, stop 167A falls, by gravity, and wedges bell crank 145 to prevent clockwise rotation thus blocking inward movement of latch bolts 35 and 127.

It will be appreciated by those skilled in the art that various changes and modifications may be made to the invention disclosed herein without departing from the scope of the invention. The invention is not to be limited by the specific embodiments given herein for purposes of illustration, but only by the scope of the appended claims and their equivalents.

I claim:

1. In an emergency exit vertical door latch adapted for mounting on a door for selectively engaging and disengaging a door strike, the door latch having a vertically operating latch mechanism, the improvement comprising:

a latch bolt means for movement along a line of action to disengage a strike and allow a door to be opened, the latch bolt means being operated by the vertically operating latch mechanism;

dead lock means for preventing unwanted opening of a door and including means for blocking movement of the latch bolt means along its line of action, the blocking means being connected between the latch bolt means and the vertically operating latch mechanism; and, means for releasing the blocking means to enable the latch bolt means to move along its line of action and including means for displacing the blocking means to permit the latch bolt means to disengage a strike on operation of the vertically operating latch mechanism.

2. The mechanism of claim 1 wherein the latch bolt means includes a latch bolt and a frame to which the latch bolt is pivotally attached for selective movement outwardly along its line of action to engage a door strike and inwardly along its line of action to disengage a strike.

3. A door latch mechanism adapted for mounting on a door for selectively engaging and disengaging a door strike, the mechanism comprising:

a latch bolt means for movement along a line of action to selectively engage and disengage a strike and allow a door to be opened, the latch bolt means including a latch bolt and a frame to which the latch bolt is pivotally attached for selective movement outwardly along the line of action to engage a door strike and inwardly along the line of action to disengage a door strike;

dead lock means for preventing unwanted opening of a door and including means for blocking movement of the latch bolt means along its line of action, the blocking means including an arm attached to the latch bolt and extending from the latch bolt along the line of action of the latch bolt means, the arm blocking movement of the latch bolt means along its line of action; and, means for releasing the blocking means and arm to enable the latch bolt means to move along its line of action and including means for displacing the arm portion of the blocking means to permit the latch bolt means to disengage a strike.

4. The mechanism of claim 3 wherein the dead lock means further includes a pin in the door latch mechanism extending transversely of the line of action of the latch bolt means, the distal end of the arm bearing against the pin when the latch bolt means is in a strike engaging position to prevent inward movement of the latch bolt means along its line of action.

5. The mechanism of claim 4 wherein the displacing means includes a bell crank pivotable about the pin.

6. A door latch mechanism adapted for mounting on a door for selectively engaging and disengaging a door strike, the mechanism comprising:

a latch bolt means for movement along a line of action to selectively engage and disengage a strike and allow a door to be opened, the latch bolt means including a latch bolt and a frame to which the latch bolt is pivotally attached for selective movement outwardly along the line of action to engage a door strike and inwardly along the line of action to disengage a door strike;

dead lock means for preventing unwanted opening of a door and including means for blocking movement of the latch bolt means along its line of action, the blocking means including an arm attached to the latch bolt and extending from the latch bolt along the line of action of the latch bolt means, the dead locking means further including a pin extending transversely of the line of action of the latch bolt means, the distal end of the arm bearing against the pin when the latch bolt means is in a strike engaging position to prevent inward movement of the latch bolt means along its line of action;

means for releasing the blocking means to enable the latch bolt means to move along its line of action and including means for displacing the blocking means permitting the latch bolt means to disengage a strike, the displacing means including a bell crank pivotable about the pin; and, wherein the arm is connected to the bell crank and to the latch bolt and the arm rotates away from the pin when the bell crank is rotated to release the blocking means and the dead lock means and permit movement of the latch bolt means inwardly along its line of action to disengage a strike.

7. The mechanism of claim 6 wherein the release means further includes bar means for manually operating the release means and linkage means for connecting the bar means and the bell crank whereby movement of the manually operable bar means produces rotation of the bell crank in an arm displacing direction and movement of the latch bolt inwardly to disengage a strike.

8. The mechanism of claim 7 further including a lever connected to the pin and movable from a retracted position to an extended position as the bell crank moves the arm away from the pin and the latch bolt disengages a door strike.

9. The mechanism of claim 8 further including spring means for urging the lever toward its extended position.

10. The mechanism of claim 9 wherein the lever has means for engaging the latch bolt, when the lever is in an extended position and the latch bolt is in a strike disengaging position, to retain the latch bolt in a strike disengaging position.

11. The mechanism of claim 7 wherein the mechanism has a second latch bolt means for movement along a line of action concurrently with the first latch bolt means to disengage the second latch bolt means from a second door strike.

12. The mechanism of claim 11 wherein the mechanism includes a second dead lock means including a second means for blocking movement of the second latch bolt means along its line of action.

13. The mechanism of claim 12 wherein the second dead lock means includes a second arm connected to a second latch bolt, and a second pin extending transversely of the line of action of the second latch bolt means, the distal end of the second arm bearing against the second pin when the second latch bolt means is in a position engaging a second strike.

14. The mechanism of claim 13 wherein the release means includes a second bell crank pivotable about the second pin.

15. The mechanism of claim 14 wherein the second arm is connected to the second bell crank and to the second latch bolt.

16. The mechanism of claim 15 wherein the linkage means is connected to the second bell crank for simultaneous operation of both bell cranks.

17. The mechanism of claim 16 wherein the release means incudes a third bell crank operable by the bar means, the third bell crank moving the linkage means.

18. The mechanism of claim 7 further including heat sensitive means for inhibiting operation of the release means in the event of fire.

19. The mechanism of claim 18 wherein the heat sensitive means includes a stop held in a first position by a fusible material which melts in the event of fire and allows the stop to move into a second position blocking movement of the linkage means.

20. The mechanism of claim 10, wherein the lever has means for disengaging the latch bolt and permitting latch bolt to return to a strike engaging position.

* * * * *

UNITED STATES PATENT AND TRADEMARK OFFICE

CERTIFICATE OF CORRECTION

PATENT NO. : 4,819,976

DATED : 4-11-89

INVENTOR(S) : Brian J. Bert

It is certified that error appears in the above-identified patent and that said Letters Patent is hereby corrected as shown below:

Column 6, line 2 after "127" delete "." and insert--,--
column 6, line 2 delete "Linkage" and insert--linkage--

Signed and Sealed this

Second Day of January, 1990

*Attest:*

JEFFREY M. SAMUELS

*Attesting Officer*

*Acting Commissioner of Patents and Trademarks*